United States Patent [19]

Hedberg

[11] 3,977,678

[45] Aug. 31, 1976

[54] RING TOSS APPARATUS USING BIOLOGICAL SYMBOLS

[76] Inventor: Martha T. Hedberg, 2330 Rochester Road, Apt. 205, Royal Oak, Mich. 48073

[22] Filed: July 14, 1975

[21] Appl. No.: 595,633

[52] U.S. Cl. ..... 273/100; D45/17

[51] Int. Cl.[2] ..... A63B 71/02

[58] Field of Search ..... 273/99, 100, 104; D29/19 R; D45/17

[56] References Cited

UNITED STATES PATENTS

| | | | |
|---|---|---|---|
| 1,616,236 | 2/1927 | Schacht | 273/100 |
| 2,009,252 | 7/1935 | Erickson | 273/100 |
| 2,356,531 | 8/1944 | Pitar | 273/104 |
| 2,504,570 | 4/1950 | Neilson | 273/104 |
| 2,832,597 | 4/1958 | Brennan | 273/104 |
| 2,922,650 | 1/1960 | Shepherd | 273/104 |
| 3,774,912 | 11/1973 | Glass | 273/100 |
| D226,955 | 5/1973 | Papavasiliou | D29/19 R |

*Primary Examiner*—Anton O. Oechsle
*Assistant Examiner*—Marvin Siskind
*Attorney, Agent, or Firm*—Reising, Ethington, Barnard, Perry and Brooks

[57] ABSTRACT

A novelty item of the disclosure includes a base, a first biological symbol of one sex mounted on the base projecting therefrom, and at least one biological symbol of the other sex that may be thrown over and caught by the base mounted symbol. The base mounted symbol is preferably of the male gender and the thrown symbol is of the female gender. Each thrown female symbol has its sex indicating cross configuration projecting from its circular portion for a distance approximately equal to the diameter of the circular portion so that the symbol may be thrown in a ring-like manner while still maintaining its shape generally like that of a biological symbol. The male symbol also has its sex indicating arrow configuration projecting from its circular portion for a distance equal to the diameter of the circular portion so as to have a shape like the female symbols. The male symbol is also preferably of the same size as the female symbols to give the novelty item an aesthetically appealing appearance.

8 Claims, 1 Drawing Figure

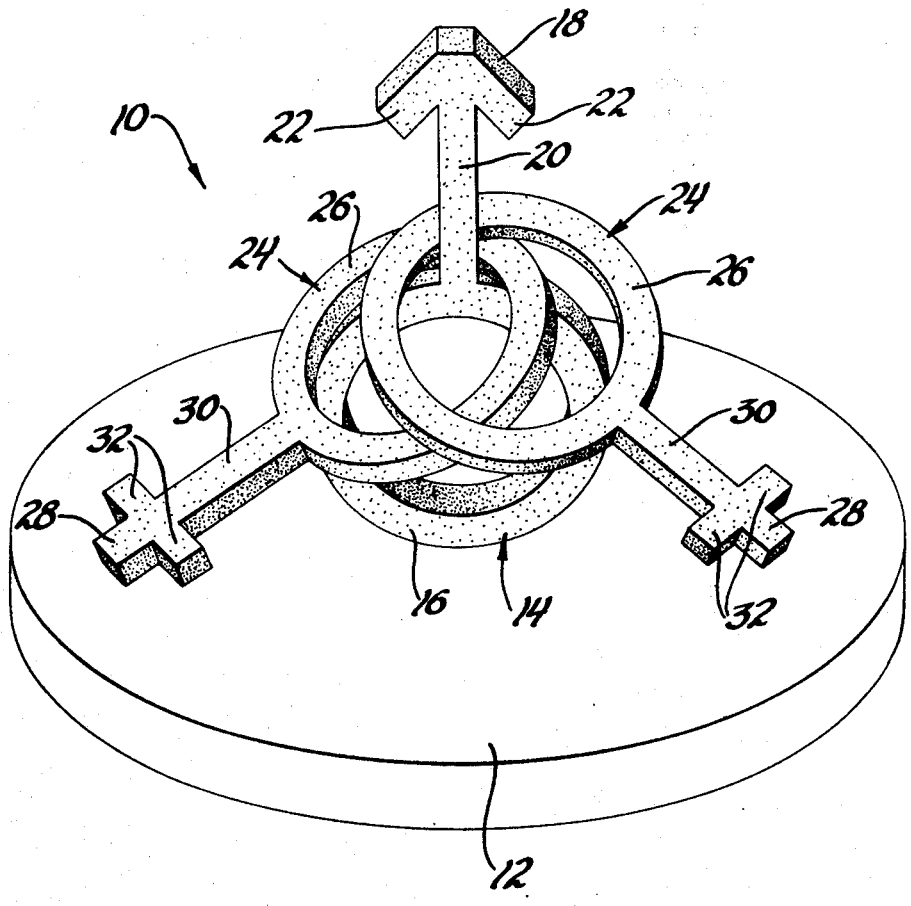
18
10
22
22
20
26
24
24
26
30
30
32
28
28
16
14
32
12

RING TOSS APPARATUS USING BIOLOGICAL SYMBOLS

BACKGROUND OF THE INVENTION

1. Field of the Invention

This invention relates to a novelty item that is particularly adapted for desk top use in an office, and table top use in the home, etc.

2. Description of the Prior Art

Novelty items used in office and home environments as well as elsewhere have different uses. The novelty items may function generally as a conversation piece to stimulate conversation between people just becoming acquainted with each other. The novelty item may also have a game feature to it that requires a person to perform a particular maneuver such as a throwing or catching feat. Likewise, the novelty item hay have both a conversational aspect as well as a game aspect.

Heretofore, novelty items of the combined conversational and game type have not utilized male and female biological symbols. These symbols, per se, are well known. The female symbol has a circular portion and a cross configuration projecting radially from the circular portion for a distance approximately equal to the diameter of its circular portion. The male biological symbol has a circular portion with an arrow configuration projecting radially from its circular portion for a distance also approximately equal to the diameter of its circular portion.

SUMMARY OF THE INVENTION

An object of the present invention is to provide a novelty item including: a first biological symbol of one sex whose circular portion is secured to a base with the sex indicating configuration thereof extending away from the base; and at least one biological symbol of the other sex whose circular portion may receive the sex indicating portion of the base mounted symbol so as to be caught thereby when thrown in the proper direction.

Another object of the invention is to provide a novelty item including: a male biological symbol whose circular portion is secured to a base with its sex indicating arrow configuration pointing away from the base; and at least two female biological symbols whose circular portions receive the male arrow configuration so as to be caught thereby when thrown in the proper direction.

In carrying out the above objects, as well as other objects, the base is preferably designed to be supported on a horizontal surface such as a desk or table top. The male symbol is secured to a central portion of the base in any suitable manner and projects vertically in an upward direction. The sex indicating arrow configuration of the male symbol has an arrowhead whose width is smaller than the internal diameter of the circular portion of the female symbols. This enables the female symbols to be thrown over the male symbol to give the item a game aspect in addition to its conversational aspect.

The female symbols each have a sex indicating cross configuration projecting radially from their associated circular portion for a distance approximately equal to the diameter of the circular portion. This enables the female symbols to be thrown in a ring-like manner while still maintaining their shape generally like that of a biological symbol. The arrow configuration of the male symbol also projects from its circular portion for a distance approximately equal to the diameter of its circular portion so as to have a shape generally like the female symbols. The male symbol is also preferably of the same size as the female symbols to give the item an aesthetically appealing appearance.

The objects, features and advantages of the present invention are readily apparent from the following detailed description of the preferred embodiment taken in connection with the accompanying drawing.

BRIEF DESCRIPTION OF THE DRAWING

The single FIGURE of the drawing is a perspective view of a novelty item that embodies the present invention.

DETAILED DESCRIPTION OF THE PREFERRED EMBODIMENT

Referring to the drawing, a novelty item embodying the present invention is generally indicated by reference numeral 10 and includes a plate-like base 12 of a somewhat rounded configuration. The base is adapted to be mounted on a horizontal surface such as a desk or table top, etc.

A male biological symbol 14 of the novelty item 10 includes a circular portion 16 whose plane is oriented vertically in an upwardly extending direction so as to be perpendicular to the horizontal base. The lower extremity of the circular portion 16 is secured in any suitable manner to a central portion of the base. The male symbol also includes an arrow configuration 18 that projects radially from its circular portion 16 in an upward direction. The arrow configuration of the male symbol includes a vertical shaft 20 whose lower end is integrally formed with the upper extermity of the circular portion 16. The upper end of shaft 20 is integrally formed with a pair of barbs 22 that cooperatively define an arrowhead which points upwardly.

The novelty item 10 also includes a pair of female biological symbols 24. Each female symbol includes a circular portion 26 and a cross configuration 28 projecting radially from the associated circular portion. Each cross configuration of the female symbols includes a shaft 30 with one end integrally formed with the associated circular portion 26 as well as a pair of cross bars 32 projecting in opposite directions adjacent the other end of the shaft. The distance between the lower ends of the barbs 22 defining the male arrowhead is less than the internal diameter of the circular portions 26 of the female symbols. Consequently, the female symbols may be thrown toward the male symbol so as to receive its arrow configuration and to be caught thereby when thrown in the proper direction. The base 12 must be heavy enough so this catching by the male symbol 14 does not move the base. The properly thrown female symbol falls downwardly so that its circular portion 26 leans against the circular portion 16 of the base mounted male symbol. If the female symbol is not thrown in the proper direction, it misses the male symbol and another toss must then be made.

The cross configuration 28 of each female symbol 24 preferably projects radially from its associated circular portion 26 for a distance approximately equal to the diameter of the circular portion. This enables the female symbol to be thrown in a ring-like manner while still maintaining its shape generally like that of the female biological symbol. Likewise, the arrow configuration 18 of the male symbol 14 also preferably projects radially from its circular portion 16 for a distance approximately equal to the diameter of the circular portion. This gives the male symbol a shape similar to the female symbols. The male symbol and the female symbols are preferably of the same size as well as of the same shape so as to give the novelty item an aesthetically appealing appearance.

The novelty item herein disclosed thus has a game feature as well as a conversational quality so as to enhance its use in the table or desk top environment, etc.

The materials from which the components of the novelty item may be manufactured are numerous. Materials such as wood or plastic are suitable. One very aesthetically appealing approach to the construction of the novelty item is to have some or all of its components made from clear plastic. This clear plastic construction gives the novelty item a very distinctive appearance to further enhance its conversational quality.

While a preferred embodiment of the novelty item has been described, those skilled in the art will recognize various alternative embodiments and constructions as defined by the following claims.

What is claimed is:

1. A novelty item comprising: a base, a first biological symbol of one sex that includes a ring-like circular portion secured to the base and also includes a sex indicating configuration connected to the circular portion thereof and extending away from the base; and at least one biological symbol of the other sex which includes a ring-like circular portion that receives the sex indicating configuration of the base mounted symbol upon being thrown thereover and which also includes a sex indicating configuration of the other sex connected to and extending away from the circular portion thereof, one of said sex indicating configurations being an arrow configuration having a shaft projecting outwardly from the associated circular portion and an arrowhead on said shaft so as to indicate the male gender, and the other sex indicating configuration being a cross configuration having a shaft projecting outwardly from the associated circular portion and a pair of cross bars so as to indicate the female gender.

2. A novelty item according to claim 1 wherein the base is adapted to be mounted on a horizontal surface.

3. A novelty item according to claim 2 wherein the biological symbol mounted on the base projects vertically from the base in an upward direction.

4. A novelty item according to claim 1 wherein the biological symbol mounted on the base is of the male gender and the other symbol is of the female gender.

5. A novelty item according to claim 4 wherein at least two of the female symbols are thrown over the male symbol mounted on the base.

6. A novelty item according to claim 1 wherein the sex indicating configuration of the thrown symbol projects from its associated circular portion for a distance approximately equal to the diameter of its circular portion so that this symbol may be thrown in a ring-like manner while maintaining its shape generally like that of a biological symbol.

7. A novelty item according to claim 6 wherein the sex indicating configuration of the base mounted symbol also projects from its associated circular portion for a distance approximately equal to the diameter of its circular portion.

8. A novelty item according to claim 7 wherein the base mounted and thrown symbols are of approximately the same size as each other to give the item an aesthetically appealing appearance.

* * * * *